US009777557B2

(12) United States Patent
Richard et al.

(10) Patent No.: US 9,777,557 B2
(45) Date of Patent: Oct. 3, 2017

(54) APPARATUS AND METHOD FOR OPERATING A DEVICE IN A WELLBORE USING SIGNALS GENERATED IN RESPONSE TO STRAIN ON A DOWNHOLE MEMBER

(71) Applicants: Bennett M. Richard, Kingwood, TX (US); Michael H. Johnson, Katy, TX (US); Jason J. Barnard, Katy, TX (US); Edward T. Wood, Kingwood, TX (US)

(72) Inventors: Bennett M. Richard, Kingwood, TX (US); Michael H. Johnson, Katy, TX (US); Jason J. Barnard, Katy, TX (US); Edward T. Wood, Kingwood, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 349 days.

(21) Appl. No.: 14/277,292

(22) Filed: May 14, 2014

(65) Prior Publication Data

US 2015/0330200 A1 Nov. 19, 2015

(51) Int. Cl.

| | |
|---|---|
| ***E21B 43/10*** | (2006.01) |
| ***E21B 44/00*** | (2006.01) |
| ***E21B 47/00*** | (2012.01) |

(52) U.S. Cl.

CPC ..... *E21B 43/10* (2013.01); *E21B 43/103* (2013.01); *E21B 44/00* (2013.01); *E21B 47/0006* (2013.01)

(58) Field of Classification Search

CPC ..... E21B 47/0006; E21B 43/10; E21B 43/103

See application file for complete search history.

(56) References Cited

U.S. PATENT DOCUMENTS

| | | | | |
|---|---|---|---|---|
| 4,501,337 | A * | 2/1985 | Dickinson, III | E21B 7/04 175/171 |
| 4,802,143 | A * | 1/1989 | Smith | E21B 21/08 175/40 |
| 5,188,183 | A | 2/1993 | Hopmann et al. | |
| 6,055,213 | A * | 4/2000 | Rubbo | E21B 41/00 175/40 |
| 7,104,324 | B2 * | 9/2006 | Wetzel | E21B 47/09 166/250.11 |
| 8,322,426 | B2 | 12/2012 | Wright et al. | |
| 8,469,106 | B2 | 6/2013 | Caminari et al. | |

(Continued)

FOREIGN PATENT DOCUMENTS

| | | |
|---|---|---|
| WO | 0033492 | 6/2000 |
| WO | 2009098498 A1 | 8/2009 |

(Continued)

OTHER PUBLICATIONS

PCT International Preliminary Report on Patentability; International Application No. PCT/US2015/025641; International Filing Date: Apr. 14, 2015; Date of Mailing: Nov. 15, 2016.

*Primary Examiner* — Shane Bomar

(74) *Attorney, Agent, or Firm* — Cantor Colburn LLP

(57) ABSTRACT

An apparatus for use in a wellbore is disclosed that in one non-limiting embodiment includes a tubular having an inside and an outside, a sensor on the outside of the tubular that provides a sensor signal in response to a strain induced in the tubular, and a processor that provides a signal responsive to the sensor signal to operate a device in the wellbore.

22 Claims, 3 Drawing Sheets

(56) References Cited

U.S. PATENT DOCUMENTS

| | | | | |
|---|---|---|---|---|
| 8,701,480 | B2 * | 4/2014 | Eriksen | E21B 47/01 73/152.51 |
| 9,091,604 | B2 * | 7/2015 | Kobata | E21B 44/00 |
| 2002/0092654 | A1 * | 7/2002 | Coronado | E21B 33/1208 166/369 |
| 2002/0125008 | A1 * | 9/2002 | Wetzel | A45C 13/02 166/278 |
| 2003/0221829 | A1 * | 12/2003 | Patel | E21B 47/123 166/278 |
| 2006/0219414 | A1 * | 10/2006 | Shuster | E21B 43/105 166/384 |
| 2008/0202810 | A1 * | 8/2008 | Gomez | E21B 47/011 175/40 |
| 2010/0132952 | A1 * | 6/2010 | Nicolas | E21B 43/103 166/369 |
| 2013/0327138 | A1 * | 12/2013 | Richard | E21B 47/09 73/152.54 |
| 2014/0126331 | A1 | 5/2014 | Skinner | |

FOREIGN PATENT DOCUMENTS

| | | | |
|---|---|---|---|
| WO | 2010037137 | A2 | 4/2010 |
| WO | 2011090491 | A1 | 7/2011 |
| WO | 2013122560 | A1 | 8/2013 |

* cited by examiner

APPARATUS AND METHOD FOR OPERATING A DEVICE IN A WELLBORE USING SIGNALS GENERATED IN RESPONSE TO STRAIN ON A DOWNHOLE MEMBER

BACKGROUND

1. Field of the Disclosure

This disclosure relates generally to deployment of devices in a wellbore.

2. Background of the Art

Wellbores are drilled in subsurface formations for the production of hydrocarbons (oil and gas). Modern wells can extend to great well depths, often more than 15,000 ft. Hydrocarbons are trapped in various traps or zones in the subsurface formations at different wellbore depths. A variety of strings are installed inside the wellbore to produce the fluids from the subsurface zones. Such strings include a number of devices on an outside of a tubular of the string, which devices are activated or deployed after the string has been conveyed and placed inside the wellbore. Such devices include, but are not limited to, liner hangers, packers, sliding sleeve valves, mechanical devices, such as packers, etc. Such devices are activated or set in the strings by mechanical, hydraulic, electrical and electrohydraulic or electromechanical devices. A common method of deploying or setting or activating such devices includes supplying a fluid under pressure from inside the tubing to an activation device via an opening cut through the tubular. Openings in the tubular tend to weaken the tubular and the fluid supplied can carry debris therewith. Interventionless actuation of such devices is, therefore, desirable.

The disclosure herein provides apparatus and methods for activating downhole devices using sensors on an outside of a tubular to provide activation signals in response to a physical change, such as strain or movement, of the tubular and using such signals to activate or deploy devices in the wellbore.

SUMMARY

In one aspect, an apparatus for use in a wellbore is disclosed that in one non-limiting embodiment includes a tubular having, a sensor on an outside of the tubular that provides a sensor signal responsive to a strain on the tubular, and a processor that provides a trigger signal responsive to the signal from the sensor. In one aspect, the trigger signal is utilized to perform a function or an operation in the wellbore.

In another aspect, a method of performing an operation in a wellbore is disclosed that in one non-limiting embodiment includes: providing a sensor on an outside of a tubular in the wellbore, wherein the sensor provides a sensor signal in response to a strain induced on an inside of the tubular; and inducing the strain on the inside of tubular to cause the sensor to provide the sensor signal. In another aspect, the method includes processing the sensor signal to provide a trigger signal for use in performing the operation in the wellbore, including activating or operating a device in the wellbore.

Examples of certain features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given like numerals and wherein.

DETAILED DESCRIPTION OF THE EMBODIMENTS

Figure 1:
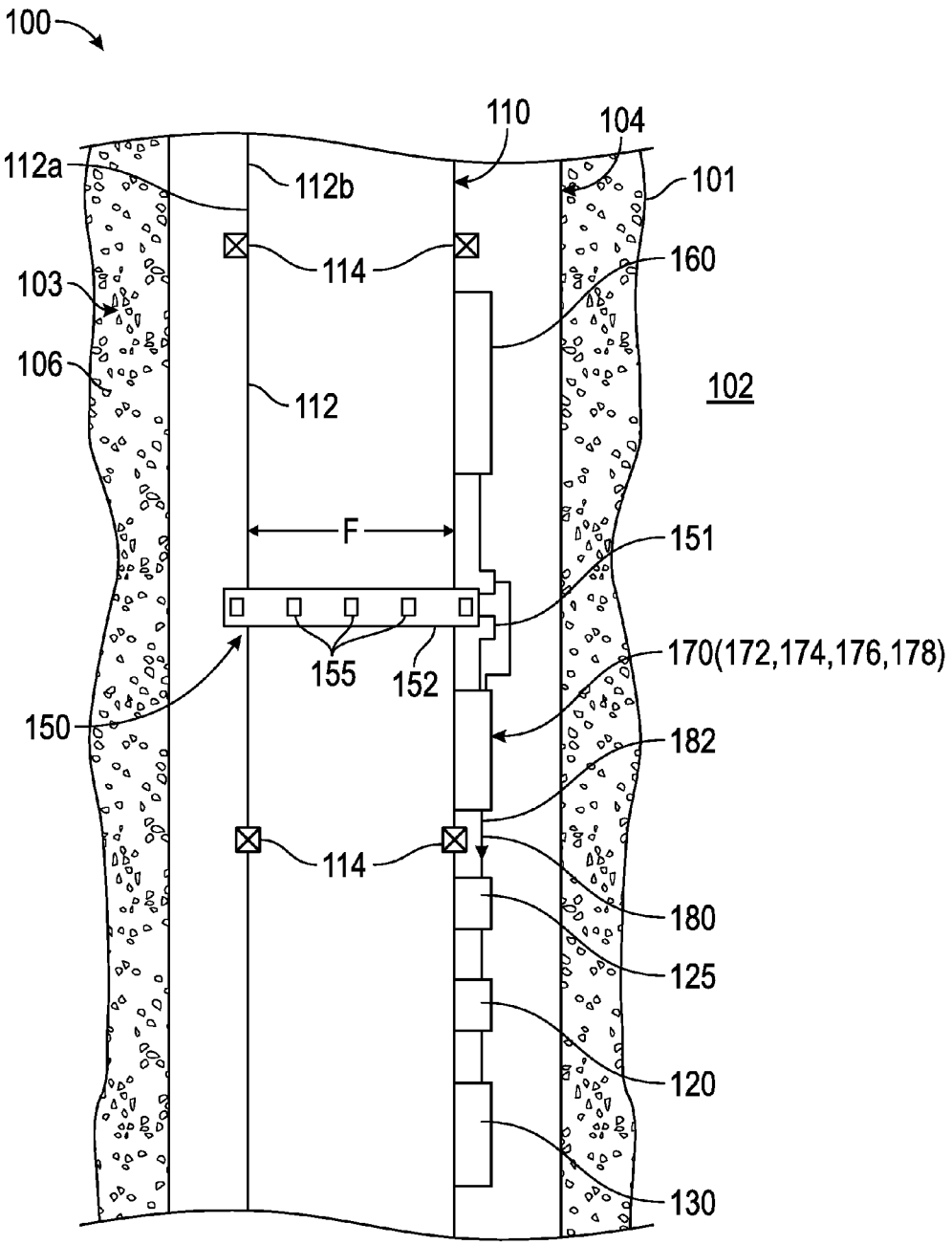
FIG. 1 shows a wellbore system that includes a sensor on an outside of a tubular for providing a signal responsive to a strain induced on the inside of the tubular for performing a downhole operation.

FIG. 1 shows a wellbore system 100 that includes a wellbore 101 formed in a formation 102. A casing 104 is shown placed in the wellbore 101. Annulus 103 between the wellbore 101 and the casing 104 is shown filled with cement 106. A string 110, which may be a completion string or another string know in the art, is shown deployed inside the casing 104. The string 110 includes a tubular or tubing 112 that in one-non-limiting embodiment includes a sensor 150 on the outside 112*a* of the tubing 112 that provides a signal in response to a strain or force (designated as "F") on the tubing 110. In one non-limiting embodiment, the sensor 150 may include one or more strain gauges or any other sensors that detect a strain on the tubular 112, including a fiber optic sensor. In one aspect, the sensor 150 may be attached to the outside 112*a* or embedded inside the wall of the tubing 112 or coupled to the tubing 112 in any suitable manner to detect the strain on the tubular 112. In another aspect, the sensor 150 may include a member 152, such as a member that includes a non-metallic material, such as sold under the trade name PEEK with one or more strain gauges 155 placed on or embedded in member 152. In another aspect, the member may be a band placed around the tubular 112, as shown in FIG. 1 that contains a number of spaced apart strain gauges 155 embedded therein so as to provide 360 degree coverage around the tubular 112. In another embodiment, one or more sensors 155 may be placed in pockets made on the wall of the tubular 112 for protection from the outside environment and electrically coupled to circuits and power source as described later. The strain F may be induced on an inside 112*b* of the tubular 112 by any suitable device or method as more fully described in reference to FIG. 3.

Still referring to FIG. 1, a control circuit or controller 170, coupled to the sensor 150, may be utilized to precondition and process signals 151 from the sensor 150 downhole. Power to the sensor 150 and the controller 170 may be provided by a battery pack 160 placed on the outside or within the wall 112*a* of the tubular 112. In aspects, the controller 170 may include a circuit 172 that conditions the signals 151 generated by the sensor 150, a processor 174, such as a microprocessor, that processes signals from the conditioning circuit 172 and generates or provides an output signal 180 (also referred to herein as a "trigger signal"). A storage device 176, such as a solid state memory, stores data and programs 178 accessible to the processor 174 for processing the signals from the circuit 172 and for generating the trigger signals. Any other circuit arrangement may be utilized to process the signals 151 and generate one or more output signals 180 useful for performing a function or an operation downhole. In other embodiments, some or all components, such as circuits, sensors, wires, etc., described herein may be placed wholly or partially in the wall of the tubular and also may be protected by epoxy or other covers, such as metallic or nonmetallic covers, from the outside environment.

Still referring to FIG. 1, the wellbore system 100 is further shown to include a work device 120 that may be operated or actuated by an actuation device 125. In aspects, any suitable actuation device may be used for the purpose of this disclosure, including, but not limited to, an electrical device, such as an electric motor, solenoid devices, a sensor, such as an acoustic sensor, and a switch. The work device 120 may be any device that may be operated by the actuation device 125, including, but not limited to, a liner hanger, sliding sleeve valve, solenoid device, and device that generates pressure pulses or acoustic hammer effect. Power to the activation device 125 and work device 120 may be supplied by a battery pack 130. In operation, the trigger signal 180 is received by the activation device 125 and in response thereto performs a selected function, such as providing a linear motion to activate the work device 120, or to open a valve or in the case of a liner hanger, moves the slips to hang the liner, etc. In aspects, the sensor and the devices 120 and 125 may be placed on a common section of the tubular 112 or in different pipe sections, such as separated by pipe joints 114. The signals 180 may be provided to the activation device via a suitable conductor 182.

Figure 2:
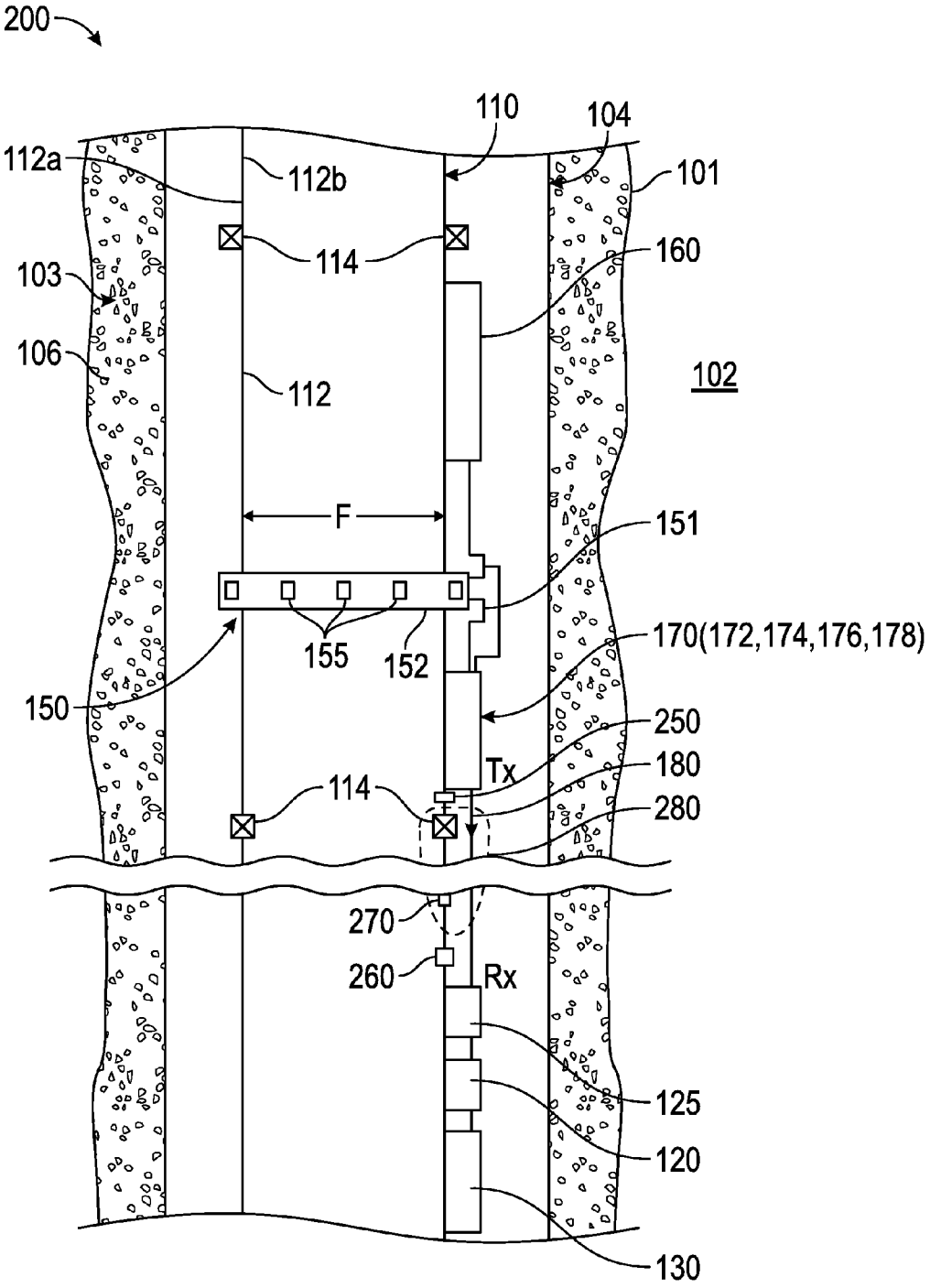
FIG. 2 shows the wellbore system of FIG. 1, except that it includes a wireless transmitter for transmitting sensor signals or processed signals for performing a downhole operation.

FIG. 2 shows the wellbore system 200 that is similar to the system 100 shown in FIG. 1 with the distinction that the trigger signal 180 is wirelessly transmitted to the activation device 125. In one non-limiting embodiment or configuration, a transmitter 250 coupled to the controller 170 transmits the trigger signal 180 to a receiver 260 that in turn provides the received trigger signal to the activation tool 125 for activating or operating the work device 120, as described in reference to FIG. 1. In one aspect, the wireless transmission may be across one or more pipe joints, such as pipe joint 114. In other aspects, one or more repeaters 270 may be used to receive the trigger signal 180 and then condition it and transmit the conditioned signal to the activation device 125, which in this case may be spaced at a greater distance from the transmitter 250.

Figure 3:
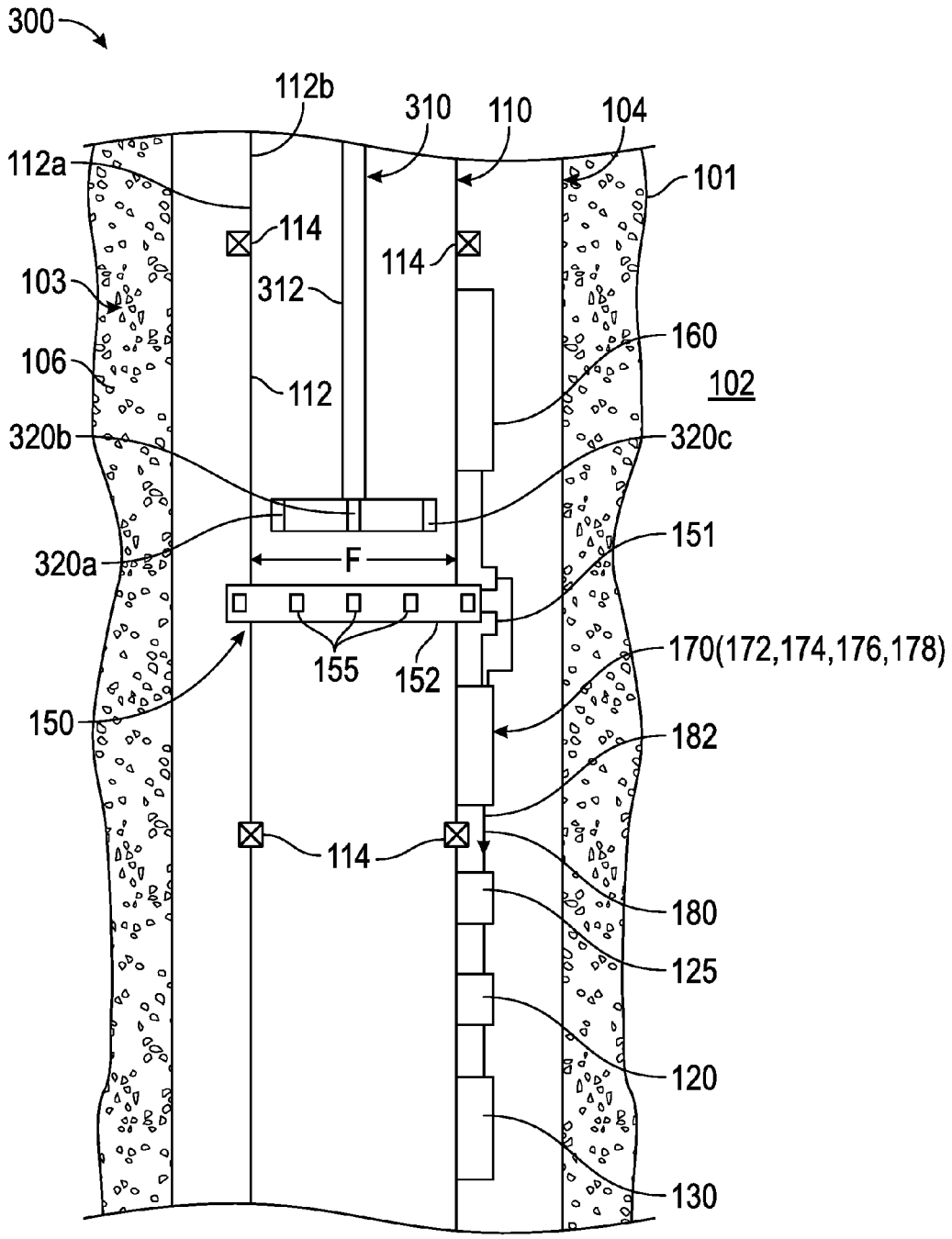
FIG. 3 shows a running tool or service tool conveyed inside the tubular shown in FIGS. 1 and 2 configured to induce a strain on the tubular.

FIG. 3 shows a wellbore system 300 that is similar to system 100 shown in FIG. 1. However, it further shows the use of a running tool or service tool 310 containing a force application device 320 for inducing a selected or desired force, pressure or strain F inside the tubing 112. Any other suitable device or mechanism may also be utilized to induce strain F in the tubular 112. In one aspect, the force application tool 320 may be conveyed by a conveying member 312, such as coiled tubing, into the tubing 112 and placed at a suitable location proximate or adjacent to the sensor 150. The tool 310 may be expanded to apply force "F" on the inside 112*b* of the tubular 112, thereby inducing a radial strain sufficient for the sensor 150 to detect. In one embodiment or configuration, the tool 320 may include expandable members 320*a*, 320*b*, 320*c* etc. that can be radially expanded, such as by an electrical pump. In another embodiment or configuration, the force application tool 320 may be expanded or ballooned hydraulically to apply the force F on the inside 112*b* of the tubular 112. In yet another embodiment or configuration, the tool 320 may act as a sonic or acoustic hammer that generates strain in the tubular 112. Any other device or method of generating a desired strain may be utilized. In aspects, the processor 174 may be programmed to provide the trigger signal 180 when the sensor signal 151 meets a selected criterion to avoid inadvertent activation of the device 120. For example, the processor 174 may provide the trigger signal 180 if the received sensor signal 151 meets a certain threshold or when the processor receives a defined sequence of signals according to programmed instruction in the program 178. One or more sensors 325*a*, 325*b* may be provided to determine the force or pressure F actually applied on the tubular. The sensor data may be transmitted by a communication link 357 to a surface controller 390 at the surface for determining the force F. The applied force may be adjusted in response to the determined force. The controller may include circuits 392, processor 394, storage device 396 and programs 398 for determining the force being applied on the tubular 312. The controller may automatically adjust the force applied by the force application device 320 in response to the determined force.

Thus, in aspects, the disclosure provides apparatus and methods for providing or generating a signal by a sensor on an outside of a member, such as a tubular, in response to a strain or movement induced on an inside of the tubular. The signal so generated may then be utilized to operate a downhole device or to perform another function downhole. In one aspect a band or ring may be coupled to a member that contains strain gauge(s) to measure deformation or strain/movement of the member due to increased internal pressure (ballooning). A processor may determine a strain threshold and relay one or more signals (trigger signals) to other devices, including, but not limited to, mechanical, electrical, electronic, electrohydraulic and other devices to operate one or more work devices, including, but not limited to opening and closing of valves, releasing spring/mechanical power devices and other activation devices. The apparatus and methods disclosed herein allow for free/open production through the tubular, such as tubular 110, FIG. 1, without the need to remove ball or seat, as is commonly the case in prior art. The system herein requires no open pressure port to transmit hydraulic force, as is commonly the case, which can weaken the tubular and is subject to damage caused by debris. Thus, the system herein provides a greater internal diameter for the production of fluids through the tubular and is relatively insensitive to debris in the tubular. The processor can be programmed to provide output signals responsive to the sensor signals when a code or pattern or a threshold has been met to avoid accidental generation of trigger signals. Although the embodiments herein described describe the use of a tool to induce a strain inside the tubular 112, the sensor 150 may provide a signal in response to a known physical change in the tubular 112, such as a movement of the tubular, a strain induced into the tubular 112 by mechanisms other than a tool deployed inside the tubular, a fluid supplied under pressure to a selected zone in the tubular, etc. The term strain is to be interpreted as meaning any such changes in the tubular.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including, but not limited to". Also, the abstract is not to be used to limit the scope of the claims.

The invention claimed is:

1. An apparatus for use in a wellbore, comprising:

a tubular;

a force application device conveyable into the tubular for applying a selected force on the tubular that induces a strain on the tubular;

a sensor on the tubular that provides a sensor signal in response to the strain on the tubular; and a processor that generates, in response to the sensor signal, a trigger signal for activating a work device downhole when the strain meets a selected criterion.

2. The apparatus of claim 1, wherein the sensor provides the sensor signal in response to one of: a deformation of the tubular; a strain due to an increased internal pressure on the tubular; a change in length of the tubular; and a change in shape of the tubular.

3. The apparatus of claim 1, wherein the sensor includes one or more sensors placed on a member forming a ring, wherein the member is one of: around an outside of the tubular; and at least partially embedded in the tubular.

4. The apparatus of claim 3, wherein the member includes a non-metallic material placed around the tubular and wherein the one or more sensors are at least partially embedded in the member.

5. The apparatus of claim 1, wherein the force application device is selected from a group consisting of: (i) a tool conveyable inside the tubular to apply a radial force to the inside of the tubular to induce the strain on the tubular; (ii) an acoustic hammer that induces the strain on the inside of the tubular; and (iii) a hydraulic device that exerts pressure on the inside of the tubular.

6. The apparatus of claim 1 further comprising an activation device that activates the work device in response to the trigger signal.

7. The apparatus of claim 6, wherein the work device is selected from a group consisting of: a setting device; a sliding sleeve; and a valve.

8. The apparatus of claim 6 further comprising a wireless transmitter that transmits the trigger signal to the activation device.

9. The apparatus of claim 8, wherein the transmitter transmits the trigger signal as one of: an acoustic signal; and an electromagnetic signal.

10. The apparatus of claim 1 further comprising a program associated with the processor that provides the trigger signal when the strain meets the selected criterion.

11. The apparatus of claim 1 further comprising a sensor associated with the force application device for determining the force applied by the force application on the tubular.

12. The apparatus of claim 1 further comprising a sensor associated with the force application device for determining the strain applied on the tubular.

13. A method of performing an operation in a wellbore, comprising:

providing a sensor on a tubular in the wellbore, wherein the sensor provides a sensor signal in response to a strain on the tubular; and conveying a force application device into the tubular;

activating the force application device to apply a selected force on the tubular that induces the strain on the tubular to cause the sensor to provide the sensor signal; and generating a trigger signal in response to the sensor signal to activate a downhole work device to perform the operation when the strain meets a selected criterion.

14. The method of claim 13 further comprising processing the sensor signal with a processor downhole to generate the trigger signal.

15. The method of claim 14 further comprising programming the processor to provide the trigger signal when the strain meets the selected threshold.

16. The method of claim 13, wherein the sensor includes a ring placed on the outside of the tubular that includes a plurality of sensors at least partially embedded in the ring.

17. The method of claim 13, wherein inducing the strain inside the tubular comprises inducing the strain by one of: (i) applying a force on the inside of the tubular by radially expanding a device inside the tubular; (ii) using an acoustic hammer inside the tubular; and (iii) radially expanding the tubular by applying a hydraulic pressure to the inside of the tubular.

18. The method of claim 13, wherein the work device is selected from a group consisting of: a setting device; a sliding sleeve; and a valve.

19. The method of claim 13 further comprising transmitting one of the sensor signal and the trigger signal by a wireless transmitter to operate the work device.

20. The method of claim 13 further comprising determining the strain applied on the tubular and altering the applied strain in response to the determined strain on the tubular.

21. A method of setting a tubular in a wellbore, the method comprising:

conveying the tubular having a setting device thereon, a sensor on an outside of the tubular and a circuit to set the setting device to set the tubular in the wellbore;

conveying a force application device into the tubular;

activating the force application device to apply a selected force on the tubular that induces a strain on the tubular to cause the sensor to provide a sensor signal; and generating a trigger signal in response to the sensor signal that activates the setting device to set the tubular in the wellbore when the strain meets a selected criterion.

22. The method of claim 21, wherein operating the setting device comprises:

activating an activation device by the trigger signal to operate the setting device.

* * * * *